US006264514B1

(12) United States Patent
Lueras

(10) Patent No.: US 6,264,514 B1
(45) Date of Patent: Jul. 24, 2001

(54) AUTOMATED STEERING MECHANISM FOR AN OUTBOARD MOTOR

(76) Inventor: Julian R. Lueras, 2528 La Vega SW., Albuquerque, NM (US) 87105

( * ) Notice: Subject to any disclaimer, the term of this patent is extended or adjusted under 35 U.S.C. 154(b) by 0 days.

(21) Appl. No.: 09/426,155

(22) Filed: Oct. 22, 1999

(51) Int. Cl.[7] ..... B63H 5/125
(52) U.S. Cl. ..... 440/58; 440/60
(58) Field of Search ..... 440/58, 63, 59, 440/60, 53; 114/144 R, 159, 144 A, 144 RE, 144 E

(56) References Cited

U.S. PATENT DOCUMENTS

| | | | | |
|---|---|---|---|---|
| D. 396,046 | | 7/1998 | Scheel et al. . | |
| 3,121,415 | | 2/1964 | Anderson et al. . | |
| 4,419,084 | | 12/1983 | Borst . | |
| 4,565,529 | | 1/1986 | Aertker et al. . | |
| 5,029,547 | * | 7/1991 | Novey | 114/159 |
| 5,355,821 | | 10/1994 | Johnson . | |
| 5,358,434 | * | 10/1994 | Brown | 440/60 |
| 5,413,062 | | 5/1995 | Koss . | |

* cited by examiner

*Primary Examiner*—Ed Swinehart

(57) ABSTRACT

A automated steering mechanism for an outboard motor for an effective and efficient alternative to cable steering. The automated steering mechanism for an outboard motor includes a housing, an electric motor, gears, an elongate drive member connected to a steering arm which is swivelly attached to an outboard motor, mounting brackets for attaching the housing to a boat, and a control unit connected with wires to the electric motor for energizing and controlling the direction of the electric motor.

5 Claims, 2 Drawing Sheets

AUTOMATED STEERING MECHANISM FOR AN OUTBOARD MOTOR

BACKGROUND OF THE INVENTION

1. Field of the Invention

The present invention relates to a mechanical outboard motor steering mechanism and more particularly pertains to a new automated steering mechanism for an outboard motor for an effective and efficient alternative to cable steering.

2. Description of the Prior Art

The use of a mechanical outboard motor steering mechanism is known in the prior art. More specifically, a mechanical outboard motor steering mechanism heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,415,062; 4,419,084; 3,121,415; 5,355,821; 4,565,529; and U.S. Pat. No. Des. 396,046.

While these devices fulfill their respective, particular objectives and requirements, the aforementioned patents do not disclose a new automated steering mechanism for an outboard motor. The inventive device includes a housing, an electric motor, gears, an elongate drive member connected to a steering arm which is swivelly attached to an outboard motor, mounting brackets for attaching the housing to a boat, and a control unit connected with wires to the electric motor for energizing and controlling the direction of the electric motor.

In these respects, the automated steering mechanism for an outboard motor according to the present invention substantially departs from the conventional concepts and designs of the prior art, and in so doing provides an apparatus primarily developed for the purpose of an effective and efficient alternative to cable steering.

SUMMARY OF THE INVENTION

In view of the foregoing disadvantages inherent in the known types of a mechanical outboard motor steering mechanism now present in the prior art, the present invention provides a new automated steering mechanism for an outboard motor construction wherein the same can be utilized for an effective and efficient alternative to cable steering.

The general purpose of the present invention, which will be described subsequently in greater detail, is to provide a new automated steering mechanism for an outboard motor which has many of the advantages of the a mechanical outboard motor steering mechanism mentioned heretofore and many novel features that result in a new automated steering mechanism for an outboard motor which is not anticipated, rendered obvious, suggested, or even implied by any of the prior art a mechanical outboard motor steering mechanism, either alone or in any combination thereof.

To attain this, the present invention generally comprises a housing, an electric motor, gears, an elongate drive member connected to a steering arm which is swivelly attached to an outboard motor, mounting brackets for attaching the housing to a boat, and a control unit connected with wires to the electric motor for energizing and controlling the direction of the electric motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automated steering mechanism for an outboard motor which has many of the advantages of the a mechanical outboard motor steering mechanism mentioned heretofore and many novel features that result in a new automated steering mechanism for an outboard motor which is not anticipated, rendered obvious, suggested, or even implied by any of the prior art a mechanical outboard motor steering mechanism, either alone or in any combination thereof.

It is another object of the present invention to provide a new automated steering mechanism for an outboard motor which may be easily and efficiently manufactured and marketed.

It is a further object of the present invention to provide a new automated steering mechanism for an outboard motor which is of a durable and reliable construction.

An even further object of the present invention is to provide a new automated steering mechanism for an outboard motor which is susceptible of a low cost of manufacture with regard to both materials and labor, and which accordingly is then susceptible of low prices of sale to the consuming public, thereby making such automated steering mechanism for an outboard motor economically available to the buying public.

Still yet another object of the present invention is to provide a new automated steering mechanism for an outboard motor which provides in the apparatuses and methods of the prior art some of the advantages thereof, while simultaneously overcoming some of the disadvantages normally associated therewith.

Still another object of the present invention is to provide a new automated steering mechanism for an outboard motor for an effective and efficient alternative to cable steering.

Yet another object of the present invention is to provide a new automated steering mechanism for an outboard motor which includes a housing, an electric motor, gears, an elongate drive member connected to a steering arm which is swivelly attached to an outboard motor, mounting brackets for attaching the housing to a boat, and a control unit connected with wires to the electric motor for energizing and controlling the direction of the electric motor.

Still yet another object of the present invention is to provide a new automated steering mechanism for an outboard motor that allows the user to mechanically steer a boat.

Even still another object of the present invention is to provide a new automated steering mechanism for an outboard motor that substantially reduces arm fatigue caused by the user having to steer the boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
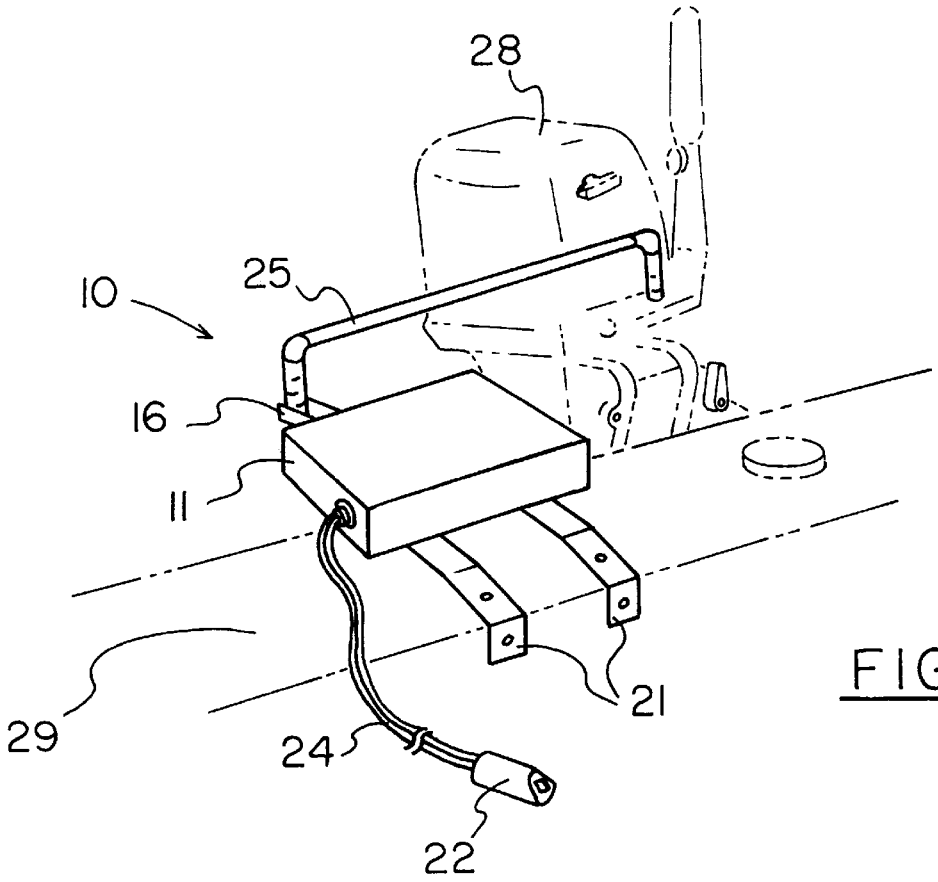
FIG. 1 is a perspective view of a new automated steering mechanism for an outboard motor according to the present invention.
Figure 2:
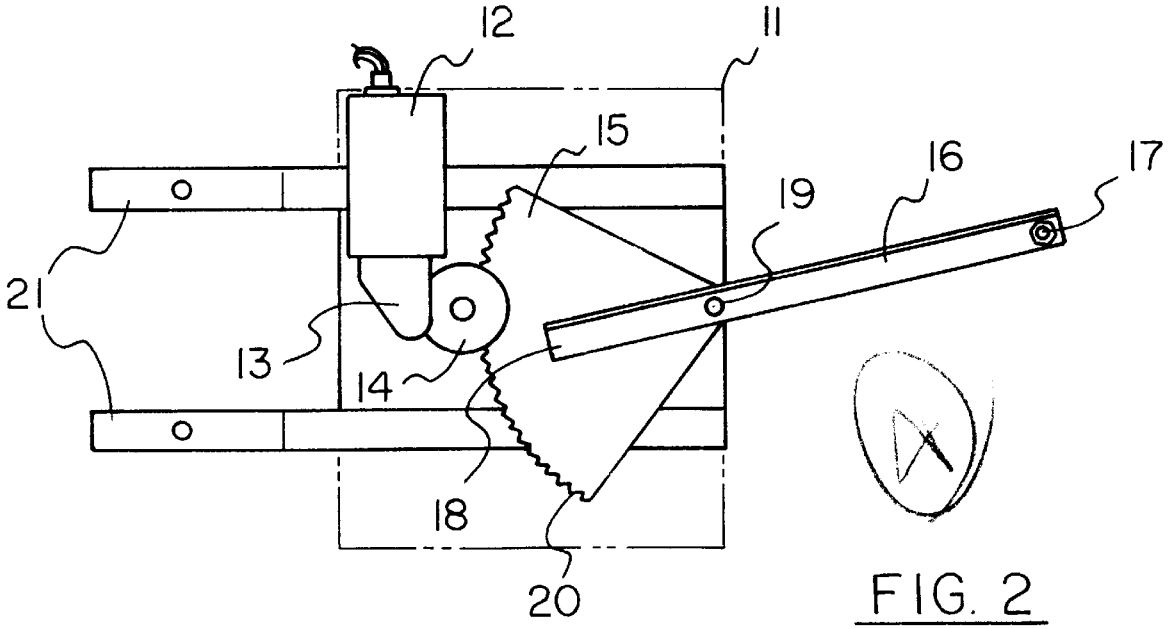
FIG. 2 is a cross-sectional top plan view of the steering actuating means of present invention.
Figure 3:
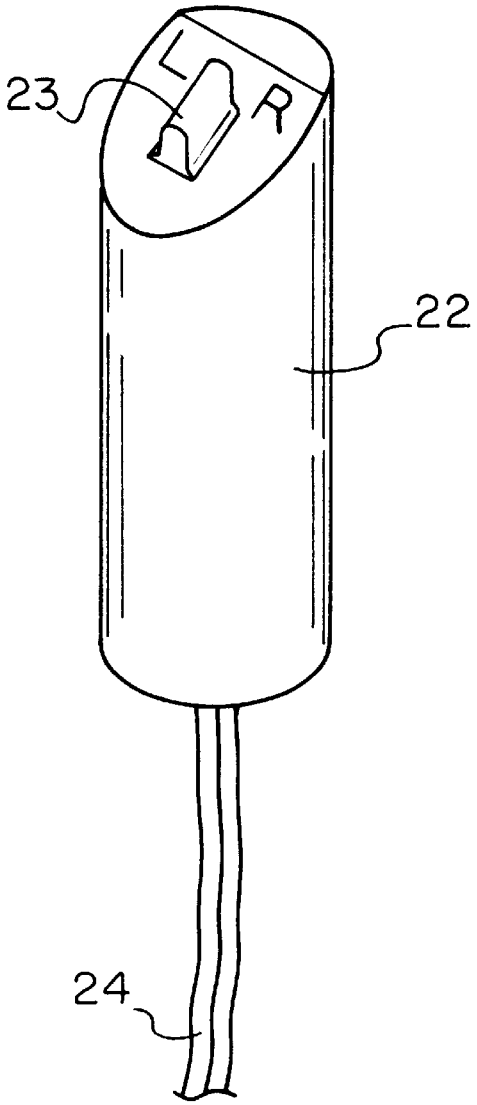
FIG. 3 is a perspective view of the control member of the present invention.
Figure 4:
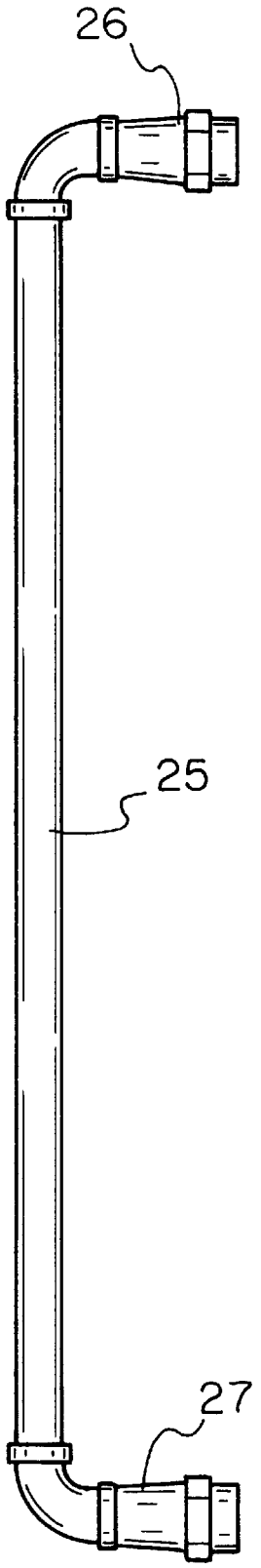
FIG. 4 is a side view of steering arm of the present invention.

With reference now to the drawings, and in particular to FIGS. 1 through 4 thereof, a new automated steering mechanism for an outboard motor embodying the principles and concepts of the present invention and generally designated by the reference numeral 10 will be described.

As best illustrated in FIGS. 1 through 4, the automated steering mechanism for an outboard motor 10 generally comprises a steering actuator means which includes an elongate drive member 16 having a first end 18 and a second end 17. The steering actuator means also includes a housing 11, a two-directional electric motor 12 securely and conventionally disposed in the housing 11. A first gear 13 is conventionally disposed near to and driven by the electric motor 12. A second gear 14 is conventionally disposed near to and driven by the first gear 13. A third gear 15 is disposed near to and driven by the second gear 14 and is securely attached with a bolt to near the first end 18 of the elongate drive member 16 which has a middle portion 19 pivotally attached with a bolt to the housing 1. The second end 17 of the elongate drive member 16 is disposed outside of the housing 11. The third gear 15 is essentially a flared or triangular member having an arcuate edge 20 which includes a plurality of teeth extending along the arcuate edge 20 which is engageable to said second gear 14. Mounting brackets 21 for supporting the steering actuator means upon a boat 29 are conventionally attached to a boat 29 near the outboard motor 28. The housing 11 is securely and conventionally attached to the mounting brackets 21. A control unit 22 is connected with wires 24 to the steering actuator means for steering a boat 29. The control unit 29 includes a switch 23 for energizing the electric motor 12. The switch 23 is connected with wires 24 to the electric motor 12 and is a two-directional switch capable of energizing the electrical motor 12 in two directions, right and left which moves the outboard motor 28 left and right. A steering arm 25 has a first end 26 and a second end 27 with the first end 26 being conventionally connected to the elongate drive member 16, and the second end 27 being swivelly and conventionally connected to an outboard motor 28.

In use, the user, instead of having to steer the outboard motor 28 by hand which can quickly fatigue the user, moves the two-directional switch 23 either to the left which energizes the electric motor 12 which, in turn, actuates the first gear 13 to rotate in one direction. The first gear 13 engages the second gear 14 which engages the third gear 15 which moves the second end 17 of the elongate drive member 16 to the left thus urging the steering arm 25 also to the left which, in turn, turns the outboard motor 28 so that the boat 29 will go in the left direction. To turn the boat 29 in the right direction, the user would move the two-directional switch 23 to the right.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automated steering mechanism for an outboard motor comprising:

a steering actuator means including an elongate drive member having a first end and a second end;

mounting brackets for supporting said steering actuator means upon a boat;

a control unit connected to said steering actuator means for steering a boat;

a steering arm having a first end and a second end, said first end being connected to said elongate drive member;

wherein said steering actuator means includes a housing, a two-directional electric motor securely disposed in said housing, a first gear driven by said electric motor, a second gear driven by said first gear, a third gear securely attached to an end of said elongate drive member which has an intermediate portion pivotally attached to said housing, wherein said third gear comprises a flared member having a substantially arcuate edge which includes a plurality of teeth disposed therealong, wherein said plurality of teeth are engageable with said second gear, said second gear being engageable with said first gear, said intermediate portion of said elongate member being pivotally coupled at an apex of said third gear, said apex of said third gear being positioned opposite said arcuate edge, said second end of said elongate member being substantially collinear with said apex of said third gear and a mid-point of said arcuate edge of said third gear such that alignment of said elongate member with said third gear reduces stress on said motor.

2. An automated steering mechanism for an outboard motor as described in claim 1, wherein said second end of said elongate drive member is disposed outside of said housing, said housing being securely attached to said mounting brackets.

3. An automated steering mechanism for an outboard motor as described in claim 2, wherein said control unit includes a switch for energizing said electric motor, said switch being connected to said electric motor.

4. An automated steering mechanism for an outboard motor as described in claim 3, wherein said switch is a two-directional switch capable of energizing said electrical motor in two directions.

5. An automated steering mechanism for an outboard motor comprising:

a steering actuator means including an elongate drive member having a first end and a second end, said steering actuator means including a housing, a two-directional electric motor securely disposed in said housing, a first gear driven by said electric motor, a second gear driven by said first gear, a third gear driven by said second gear and being securely attached to said first end of said elongate drive member which has an intermediate portion pivotally attached to said housing, said second end of said elongate drive member being disposed outside of said housing, said third gear comprises a flared member having substantially arcuate edge which includes a plurality of teeth extending along said arcuate edge, said intermediate portion of said elongate member being pivotally coupled at an apex of said third gear, said apex of said third gear being positioned opposite said arcuate edge, said second end of said elongate member being substantially collinear with said apex of said third gear and a mid-point of said arcuate edge of said third gear such that alignment of said elongate member with said third gear reduces stress on said motor;

mounting brackets for supporting said steering actuator means upon a boat, said housing being securely attached to said mounting brackets;

a control unit connected to said steering actuator means for steering a boat, said control unit including a switch for energizing said electric motor, said switch being connected to said electric motor and being a two-directional switch capable of energizing said electrical motor in two directions, right and left; and a steering arm having a first end and a second end, said first end being connected to said elongate drive member, and said second end being swivelly connected to an outboard motor.

* * * * *